United States Patent [19]

Wanke

[11] 4,142,657

[45] Mar. 6, 1979

[54] DISPENSING CLOSURE WITH NONRIGID FOLLOWER

[76] Inventor: Ronald L. Wanke, 1920 N. Clark St., Apt. 13A, Chicago, Ill. 60614

[21] Appl. No.: 797,183

[22] Filed: May 16, 1977

Related U.S. Application Data

[63] Continuation-in-part of Ser. No. 556,945, Mar. 10, 1975, abandoned.

[51] Int. Cl.[2] ..... B65D 51/16

[52] U.S. Cl. ..... 222/386.5; 215/309; 222/479

[58] Field of Search ..... 222/479, 478, 481.5, 222/386.5, 130, 80, 563; 215/11 B, 11 E, 307-315

[56] References Cited

U.S. PATENT DOCUMENTS

| | | | |
|---|---|---|---|
| 209,244 | 10/1878 | Gaffron | 222/386.5 |
| 601,877 | 4/1898 | Lochmann | 222/130 |
| 1,695,076 | 12/1928 | Zohe | 215/11 E |
| 1,977,862 | 10/1934 | Scholtes | 222/386.5 |
| 2,796,205 | 6/1957 | Kuzma | 222/563 X |
| 3,294,289 | 12/1966 | Bayne et al. | 222/386.5 X |
| 3,343,701 | 9/1967 | Mahoney | 215/307 X |
| 3,506,167 | 4/1970 | Orr | 222/479 |
| 3,584,770 | 6/1971 | Taylor | 222/479 |

*Primary Examiner*—Robert J. Spar
*Assistant Examiner*—Francis J. Bartuska

[57] ABSTRACT

A dispensing closure for liquid containing containers which have different neck diameters includes a cap having an annular skirt which engages the interior neck of the containers. The cross section of the annular skirt is noncircular due to an indented pouring spout which extends along the skirt, and which is distortable to maintain the annular skirt in engagement with container necks of different diameters. A follower bag when collapsed is housed entirely within the protecting annular skirt, and has an opening mouth sealed to the cap and contiguous with a vent aperture through the top of the cap. The follower bag is of a size, when inflated, on the order of the interior size of the container. A plunger has an elongated neck releasably secured within the vent aperture, and an enlarged head adjacent the open end of the annular skirt. Before liquid is dispensed, the plunger is forced into the chamber to cause the follower bag to fall onto the liquid surface. As liquid is dispensed through the spout, air enters the vent aperture and continues to inflate the follower bag.

13 Claims, 7 Drawing Figures

DISPENSING CLOSURE WITH NONRIGID FOLLOWER

CROSS REFERENCE TO RELATED APPLICATION

This application is a continuation-in-part of my copending application entitled "Dispensing Closure With Non-Rigid Follower", Ser. No. 556,945, filed Mar. 10, 1975 now abandoned.

BACKGROUND OF THE INVENTION

This invention relates to a dispensing closure having a nonrigid follower bag.

To dispense liquid stored in a sealed container, the sealing stopper or cork can be removed and replaced with a dispensing closure having a nonrigid follower or bag. As the liquid contents are dispensed through a pouring spout, air inflates the follower bag which expands into the container interior to occupy the space corresponding to the dispensed liquid. The follower bag prevents contact of ambient air with the liquid contents, and thereby helps to prevent or delay oxidation and resulting spoilage of the liquid contents.

In prior dispensing closures of the above type, the follower bag when collapsed has extended a substantial distance beyond the closure cap, creating packaging and contamination problems. Also, the dispensing closure has been usable only with liquid containers having necks of the same dimensions. Unfortunately, bottles of similar sizes when produced by different manufacturers have neck diameters which vary greatly. Although a dispensing closure made of rubber or cork can be sufficiently compressed to be frictionally retained within such different diameter necks, such materials are not suitable for dispensing closures with follower bags, nor can such closures be injection molded.

To deploy the follower bag, it has been necessary to dispense liquid through the pouring spout in order that air will inflate the follower bag. If liquid has been dispensed from a container, and it is then decided that the remaining contents should be saved, the use of a follower bag type closure is generally impractical, since the liquid has already been dispensed, and no mechanism is available for deploying the follower bag within the container, except by dispensing additional liquid, which may not be desired.

Also, an unduly large number of parts and assembly operations have been required to manufacture prior dispensing closures with follower bags, resulting in increased costs which make the use of such devices impractical for delaying spoilage in low cost consumer products, such as wine. To obviate cleaning of the follower bag and to prevent contamination of the liquid product, the dispensing closure device preferably should be disposable after use. When the device is intended for widespread use by the public, it must be of durable, compact construction, and must prevent release of the follower bag prior to insertion in the container.

SUMMARY OF THE INVENTION

In accordance with the present invention, the problems noted above with prior dispensing closures having nonrigid follower bags have been overcome. The follower bag is entirely housed within a distortable annular skirt which maintains frictional engagement with container necks of varying diameters. A plunger maintains the follower bag within the protecting annular skirt until ready for deployment, at which time the plunger is released and by gravity carries the entrapped follower bag down to the liquid level. An open channel in the plunger maintains the interior of the follower bag at outside atmospheric pressure, and allows release even when the closure has been distorted due to the diameter of the container neck.

The dispensing closure can be formed of only three separate plastic parts which are easily assembled, producing a low cost device which is disposable after a single use. The follower bag is of a size on the order of the interior size of the container, and is nondistendable. The follower bag can be economically formed by a folded plastic sheet which has been cut and heat sealed along two edges. The follower bag is transparent and may have a cloudy or multi-faceted surface so as to diffuse and deflect light in order to increase the transparency of the inflated follower bag.

One object of the present invention is the provision of a dispensing closure having a nonrigid follower bag which is compactly housed within a distortable annular skirt which adapts to container necks of varying diameters.

Another object of the present invention is the provision of a dispensing closure having a nonrigid follower bag which can be deployed prior to pouring of liquid through a spout.

Other objects and features of the invention will be apparent from the following description and from the drawings. While an illustrative embodiment of the invention is shown in the drawings and will be described in detail herein, the invention is susceptible of embodiment in many different forms and it should be understood that the present disclosure is to be considered as an exemplification of the principles of the invention and is not intended to limit the invention to the embodiment illustrated.

DESCRIPTION OF THE PREFERRED EMBODIMENT

Figure 1:
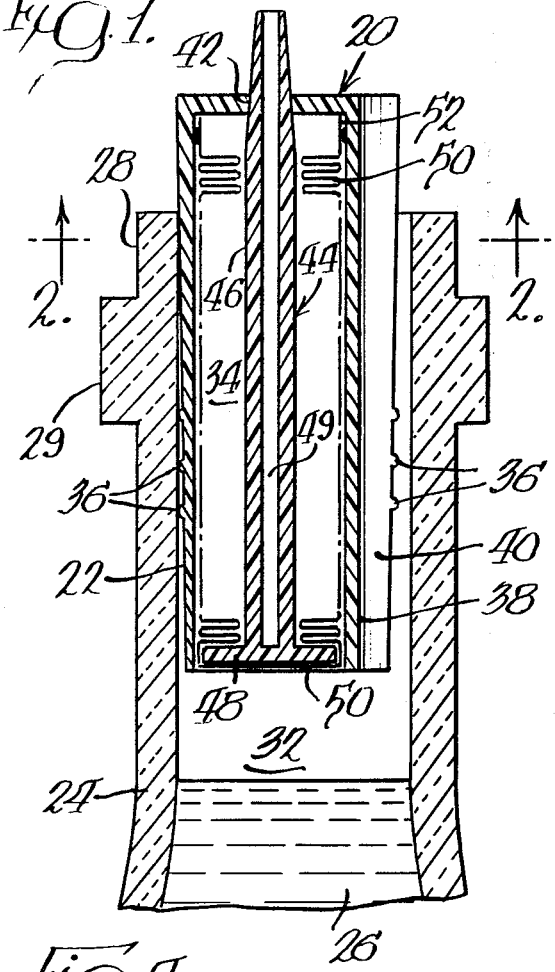
FIG. 1 is a cross-sectional side view of the neck portion of a liquid containing bottle fitted with the novel dispensing closure.
Figure 2:
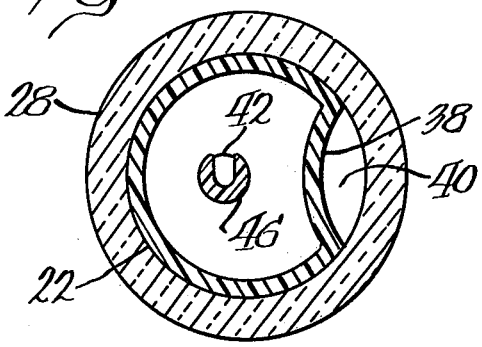
FIG. 2 is a cross-sectional view of the bottle neck and the dispensing closure (without the follower bag), taken along lines 2—2 of FIG. 1.

Referring to FIGS. 1 and 2, the novel dispensing closure comprises a plastic cap 20 having an integral annular skirt 22 which extends downward from the top of the cap and which snugly engages the neck of a container 24 which stores a liquid 26 which will oxidize or spoil on contact with oxygen. Illustratively, the container 24 is in the form of a transparent or semi-transparent glass bottle for storage of wine, and has an annular neck 28 with an integral bead 29. After a user removes the original closure for the wine bottle, and either before or after dispensing wine, the cap 20 is inserted into the bottle neck 28, and occupies approximately the same space as occupied by the original cork or other stopper device which sealed the wine bottle. Below the bottom of the closure device (as well as initially below the cork or stopper), a headspace 32 exists above the nornal fill level for the wine. While the headspace 32 can be occupied by an inert gas, it typically consists of air which allows slow oxidation of the wine. The initial stopper is generally a porous cork which allows air to slowly seap into the headspace 32 in order to continue the natural aging process.

The annular skirt 22 defines an elongated interior chamber 34 having an axial length which is substantially longer than the diameter of the chamber. The annular skirt 22 has a slightly tapering or frusta-conical shape with a wall thickness which decreases as the skirt extends away from the top of the cap 20. A plurality of semi-arcuate beads 36 circumferentially surround the lower middle portion of the skirt, and frictionally contact the container neck.

The cross section of the annular skirt 34 is circular for a portion greater than 180°, but is noncircular with respect to the major arc for the remaining minor arc. The noncircular portion of the skirt is formed by a concave indented wall 38 which extends from the top of the cap to the bottom thereof so as to define an open channel or pouring spout 40. The entire pouring spout 40 is delineated by the arcuate indent 38 of the skirt wall and by the opposite facing interior wall of the bottle neck 28, as seen best in FIG. 2.

The top of cap 20 contains a circular vent aperture 42 which vents the interior of chamber 34 to ambient air. A plastic plunger 44, initially located generally within the interior chamber 34, comprises an elongated U-shaped neck 46 having an enlarged head 48 spaced away from the annular skirt 22 by a small air gap, but of similar cross section to the skirt 22. The main body of the plunger neck 46 has a diameter greater than the diameter of the circular vent aperture 42. However, at the upper portion the neck 46 tapers in diameter so that at its outermost extent, it is of lesser diameter than the diameter of the circular vent aperture 42. The tapering upper portion of the neck 46 is wedged within the vent aperture 42. Upon receiving a downward thrust, as will appear, the plunger 44 is released from frictional engagement with the wall of the vent aperture 42. The U-shaped cross section of the neck 46 defines an elongated open channel 49 which extends along the entire length of the elongated neck 46.

The interior chamber 34 houses a nonrigid follower bag 50 which is of a size on the order of the interior size of the container 24. The follower bag 50 is formed of a transparent plastic material, such as polyethylene, having a cloudy or multifaceted surface so as to diffuse light and to thereby increase its apparent transparency. The follower bag preferably is nondistendable, that is, it is not substantially elastic or rubber-like in construction. This eliminates the forces which are present in an elastic, rubber-like balloon which, when inflated, would cause increased pressure which would tend to collapse the follower bag. The single opening or mouth 52 of the follower bag is hermetically sealed, such as by heat sealing, to the cap so that the interior of the follower bag 50 is contiguous with the interior chamber 34 and vent aperture 42. Illustratively, the mouth 52 is heat sealed to the upper, interior vertical wall of the annular skirt, but it could be secured, for example, to the lower exterior vertical wall of the annular skirt, adjacent the mouth thereof.

During assembly of the closure device, the opening 52 of the bag is sealed to the cap after the plunger 44 has been located therein. The follower bag 50 is then stuffed around the elongated neck 46 of the plunger, and the assembly is inserted into the interior chamber 34 until the tapering portion of the neck 46 frictionally engages the wall of the vent aperture 42. In this position, as seen in FIG. 1, the plunger head 48 is slightly above the opening of the annular skirt 22; and the center portion of the follower bag 50 surrounds the head, with the remainder of the following bag 50 being compactly collapsed or folded within the interior chamber formed between the skirt wall 22 and the plunger neck 46. After assembly, the interior 34 is vented to exterior air by the elongated chamber 49, so that a decrease in atmospheric pressure will not cause entrapped air to deploy the follower bag prior to its intended use.

Figure 4:
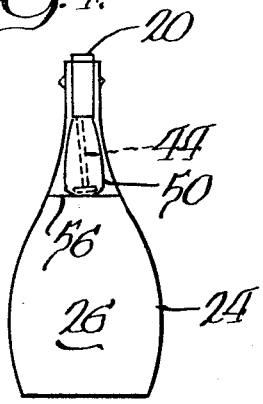
FIG. 4 is a diagramatic illustration showing deployment of the nonrigid follower bag by the releasable plunger.

The dispensing closure 20 may be inserted into an opened wine bottle whenever the user decides that the contents are to be saved. This may occur either before or after some of the contents of the bottle have been poured through the container neck. The cap 20 is snugly inserted and seated within the container neck, after which the user depresses the extending top of the plunger neck 46. When the tapering neck no longer frictionally engages the wall of the vent aperture 42, the plunger 44 falls downward, partly by gravity and partly due to the initial thrust, carrying the encaptured follower bag 50 with it, until contacting the surface 56 of the liquid, as seen in FIG. 4. Although the follower bag 50 will not be fully opened by the released plunger 44, the bag will contact a sufficient extent of the liquid surface and/or will block the air passage to the spout 40, so as to inhibit oxidation. Air corresponding to the headspace 32 will still be present, of course, but the follower bag will act to substantially decrease spoilage so long as a major portion of the liquid surface 56 is covered thereby. If automatic opening of the bag 50 is desired, the plunger can be formed of several pieces which open after release, or a coiled spring can surround the neck 46, except that such an opening device must not hang up the plunger within the surrounding skirt 22 or in the bottle neck.

Figure 5:
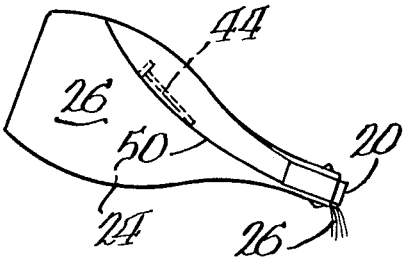
FIGS. 5 and 6 are diagramatic illustrations showing the operation of the nonrigid follower bag during dispensing of liquids from the bottle.

As the bottle is tilted, the wine 26 will flow through the pouring spout 40, creating a vacuum or low pressure area with respect to ambient air. The external air is thus drawn through the vent aperture 42 and into the interior of the follower bag 46 to inflate the same. As seen in FIG. 5, the follower bag 50 will be sucked into the interior of the bottle, and will float over the liquid being dispensed. As the bottle is turned upright, the follower bag 50 will float on top of the liquid, and will generally occupy the space corresponding to the displaced liquid. The plunger 44 should be sufficiently flexible to prevent puncture of the bag 50.

As the bottle is being uprighted, the pressure of the liquid contents against the follower bag 50 may collapse the bag slightly. To prevent this occurrence, a one direction valve may be associated with the air vent 42 so as to close and prevent escape of interior air which has been drawn into the follower bag. Although increased oxidation will occur without such a valve, the oxidation will be substantially less than what would have occurred without the presence of the follower bag.

Figure 6:
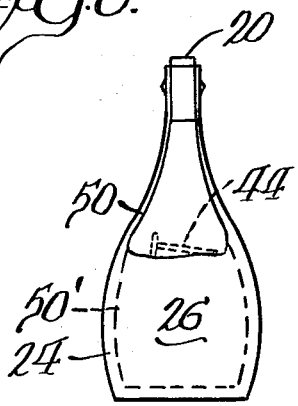

As the bottle is again tilted, the liquid will force the follower bag to ride up and over the liquid, thereby unblocking the pour spout 40 so that wine can be dispensed, as shown in FIG. 5. As the bottle is again tilted upright, the follower bag 50 will be forced to change shape, and gradually will occupy most of the interior space of the bottle, as indicated by the dashed lines 50' in FIG. 6.

Oxidation of the wine can be reduced by inserting the dispensing closure 20 into the container neck as soon as the original cork or stopper is removed therefrom. Even if the user should forget to depress the plunger, any attempt to dispense liquid through the spout will generally cause the plunger and air bag to be sucked into the interior of the bottle. In addition, the present dispensing closure has the advantage that it can be inserted into a wine bottle even after substantial portions of the contents have been dispensed, since depression of the plunger will release the follower bag 50 into the interior of the bottle, without pouring any contents out of the bottle.

The shape of and material forming the cap 20 are selected to allow the skirt 22 to distort in a manner which compensates for container necks of varying diameter. For example, a 750 ml. wine bottle has a nominal diameter of ¾ inch. In fact, however, the neck diameter and taper will vary for different bottle manufacturers, and at the top of the neck, the inside diameter will range from 0.740 inches to less than 0.700 inches. The cap 20 of the present invention is injection molded from a medium density polyethylene.

Figure 3:
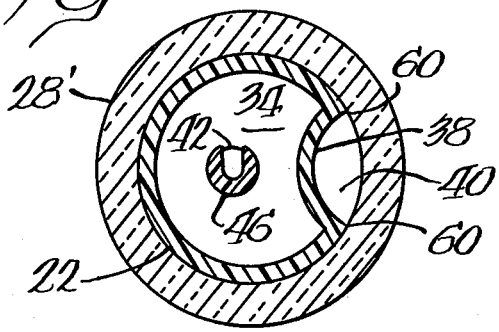
FIG. 3 is a cross-sectional view similar to FIG. 2, but with the same dispensing closure located within a bottle neck of reduced diameter.

When the cap 20 is inserted within a container neck 28' of smaller diameter, as shown in FIG. 3 (not to scale), the indented wall 38 distorts further into the interior chamber 34, and the edges 60 between the circular cross section and the concave wall 38 are circumferentially extended further into the space of the pouring spout 40. This distorted cross section, in combination with the plastic material forming a cap, causes the annular skirt 22 to be retained in snug frictional engagement with the smaller container neck.

Figure 7:
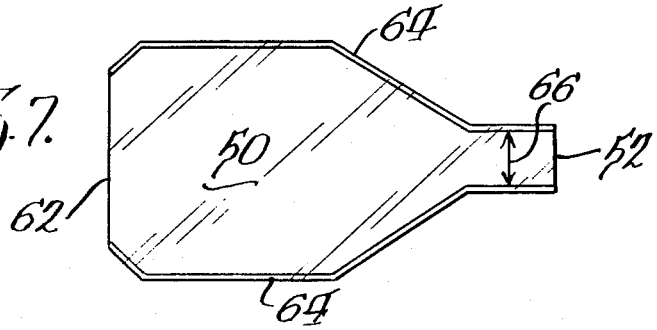
FIG. 7 is a top plan view showing the construction of the follower bag.

The follower bag 50 has a shape which is somewhat similar to the interior shape of the container. The bag may be cylindrical and formed by a blow molding process, but such bag is expensive to produce. Where more economy is desired, the bag of FIG. 7 may be utilized. A sheet of flat plastic, such as polyethylene, is folded over, so that the open edges are at 52, and the elongated fold is at 62. The folded plastic sheet is then cut along its two sides 64, and has a reduced width neck 66 which, when opened, has a diameter on the order of the diameter of the annular skirt 22. The pair of side edges 64 are heat sealed, thereby forming an air-tight bag having a single opening mouth 52. The cutting and heat sealing of the edges 64 may occur in a single operation. The width of the flat bag, between the sides 64, should be approximately $\pi/2$ times the interior diameter of the container, so that when opened in a cylindrical shape, the diameter of the bag will occupy most of the interior space of the container. The wall thickness of the bag is on the order of 0.001 inch or less, so that it is sufficiently flexible to assume a cylindrical shape when opened.

Various modifications may be made to the illustrated embodiment. In place of the plunger 44, a body such as a plastic cylinder can be suspended within the interior of the chamber by means of a string or wire which extends through the vent aperture 42, and is held in place by a peel or tear-off tab over the vent aperture. Removal of the peel off tab would simultaneously open the vent aperture and release the suspended body, which would fall by gravity into the interior of the container, carrying the bag 50 with it. While cap 20 has been illustrated as a one-piece molded part, it can be formed of several parts which are secured together, such as a flat top cap which is sealed to a circular annular skirt, with the follower bag being captured between the flat top and the annular skirt. Other modifications will be apparent in view of the above teachings.

I claim:

1. A dispensing closure for liquid containing containers having necks of different diameters, comprising:

a cap having an annular skirt which surrounds an open chamber, the cross section of the annular skirt being generally circular for a majority of the periphery and indented for the remaining portion of the periphery to form a pouring spout extending along the sides of the annular skirt, a vent aperture extending through the cap to vent the open chamber to exterior air, the annular skirt being distortable in cross section when inserted into container necks of different diameters for maintaining the cross section in frictional engagement against the container neck to retain the cap therein, and a nonrigid bag having a single opening mouth secured to the cap so that the interior of the bag is contiguous with the open chamber, the bag when collapsed being housed substantially entirely within the annular skirt and inflated by air entering the vent aperture as liquid is dispensed through the spout.

2. The dispensing closure of claim 1 wherein the cap and annular skirt is a unitary piece molded from polyethylene material.

3. The dispensing closure of claim 1 wherein the annular skirt has a tapering wall thickness which decreases from the top portion of the cap to the open mouth through which the nonrigid bag inflates into the container, and a plurality of beads circumferentially surround at least the circular cross section of the annular skirt.

4. The dispensing closure in claim 1 wherein the indented pouring spout comprises a concave wall which can distort radially inward when the container neck has smaller diameters.

5. The dispensing closure of claim 1 wherein the nonrigid bag is formed of polyethylene and is heat sealed to the annular skirt.

6. The dispensing closure of claim 1 wherein the nonrigid bag is formed of a folded plastic sheet which is heat sealed along two sides thereof, the folded edge forming the third side of the bag, and the fourth side of the bag being open and sealed to the periphery of the annular skirt.

7. A dispensing closure for liquid containing containers having necks of different diameters, comprising:

a cap having an annular skirt which surrounds an open chamber, the cross section of the annular skirt being generally circular for a majority of the periphery and indented for the remaining portion of the periphery to form a pouring spout extending along the sides of the annular skirt, a vent aperture extending through the cap to vent the open chamber to exterior air, the annular skirt being distortable in cross section when inserted into container necks of different diameters for maintaining the cross section in frictional engagement against the container neck to retain the cap therein, a nonrigid bag having a single opening mouth secured to the cap so that the interior of the bag is contiguous with the open chamber, the bag when collapsed being housed substantially entirely within the annular skirt and inflated by air entering the vent aperture as liquid is dispensed through the spout, and a releasable member having a first portion extending through the vent aperture and a body portion located within the open chamber, the first portion being releasable to thereby drop the body portion and entrapped bag to the liquid level in the container before liquid is poured through the spout.

8. A dispensing closure for the neck of a container intended to be tilted to dispense liquid contained therein, comprising:

a cap seatable within the container neck and having a vent aperture extending therethrough and a pouring spout, a nonrigid bag sealed to the cap and contiguous with the vent aperture to allow air to inflate the bag as liquid is dispensed through the spout, and a releasable member located within the nonrigid bag and freely releasable from engagement with the cap to drop to the liquid surface and thereby float the bag on the liquid, the bag and releasable member being free to change positions within the container as the container is tilted to pour the liquid through the spout.

9. The dispensing closure of claim 8 wherein the releasable member comprises a main body having an extension which extends through the vent aperture to suspend the main body until the extension is released through the vent aperture.

10. A dispensing closure for the neck of a liquid containing container, comprising:

a cap seatable within the container neck and having a vent aperture extending through the cap, a pouring spout, and an annular skirt which surrounds an open chamber, a nonrigid bag sealed to the cap and located when collapsed substantially within the annular skirt and being contiguous with the vent aperture to allow air to inflate the bag as liquid is dispensed through the spout, a plunger having an enlarged head located within the nonrigid bag and an elongated neck of reduced diameter extending at least partially through the vent aperture and frictionally engaged by the wall of the vent aperture to suspend the plunger within the open chamber, the nonrigid bag, except for the portion surrounding the enlarged head, being located within the open chamber so that the annular skirt houses substantially the entire collapsed bag, the neck being releasable from frictional engagement with the vent aperture wall to drop the plunger to the liquid level and thereby deploy the bag into the container before liquid is poured through the spout.

11. The dispensing closure of claim 10 wherein the elongated neck of the plunger includes an open channel which extends at least from a portion external to the cap through a portion of the open chamber so as to vent the open chamber to exterior air before the plunger is released.

12. The dispensing closure of claim 10 wherein the cross section of the annular skirt is generally circular for a majority of the periphery with the remaining portion of the periphery being indented so as to form the pouring spout, the annular skirt being distortable when seated in container necks of different diameters so as to frictionally retain the cap within the container neck.

13. The dispensing closure of claim 12 wherein the vent aperture is located in the top portion of the cap, and the elongated neck of the plunger having a distortable cross section.

* * * * *